US005666752A

United States Patent [19]

Grams

[11] Patent Number: 5,666,752

[45] Date of Patent: Sep. 16, 1997

[54] HAND GUN MAGAZINE EXTENSION ASSEMBLY

[76] Inventor: Beven Grams, 2435 Norse Ave., Costa Mesa, Calif. 92627

[21] Appl. No.: 748,684

[22] Filed: Nov. 13, 1996

[51] Int. Cl.[6] ..... F41A 9/71

[52] U.S. Cl. ..... 42/49.02; 42/50

[58] Field of Search ..... 42/49.02, 50, 7

[56] References Cited

U.S. PATENT DOCUMENTS

| | | | |
|---|---|---|---|
| 951,657 | 3/1910 | Pedersen | 42/49.01 |
| 1,015,490 | 1/1912 | Harrington | 42/7 |
| 1,133,281 | 3/1915 | Hammond | 42/7 |
| 1,184,078 | 5/1916 | Cooke | 42/7 |
| 3,399,481 | 9/1968 | Giorgini | 42/49.01 |
| 4,139,959 | 2/1979 | Howard et al. | 42/50 |
| 4,310,982 | 1/1982 | Kast et al. | 42/49.01 |
| 4,495,720 | 1/1985 | Bross | 42/7 |
| 4,514,922 | 5/1985 | Farrar et al. | 42/7 |
| 4,520,585 | 6/1985 | Barrett | 42/7 |
| 4,765,081 | 8/1988 | Dieringer | 42/50 |
| 5,081,778 | 1/1992 | Switzer | 42/50 |
| 5,206,444 | 4/1993 | Oliver | 42/7 |
| 5,329,718 | 7/1994 | Howard | 42/50 |
| 5,438,783 | 8/1995 | Sniezak et al. | 42/7 |

FOREIGN PATENT DOCUMENTS

| | | | |
|---|---|---|---|
| 146383 | 7/1954 | Sweden | 42/50 |
| 848965 | 7/1981 | U.S.S.R. | 42/50 |

*Primary Examiner*—Stephen M. Johnson
*Attorney, Agent, or Firm*—Price, Gess & Ubell

[57] ABSTRACT

In a hand gun used for target or staged shooting, a magazine tube utilizing a standard base pad limits the number of rounds that can be carried by that magazine. The present invention is a magazine extension assembly comprising a base pad and adapter which can be easily fitted to a variety of hand gun magazines and which augments the capacity of the magazine. The adapter includes a groove which receives the lip of the magazine tube base to secure the adapter to the magazine tube. The adapter and base pad include meshing surfaces which include a traverse channel for securing the two together. A clip is inserted into the traverse channel to lock the base pad to the adapter and form a reservoir below the magazine tube which is used to store additional rounds. In a preferred embodiment the base pad includes a tab to retain the clip in the traverse hole, and a recess is provided whereby the clip can be removed using a bladed instrument.

29 Claims, 4 Drawing Sheets

102
122
124
132
120
130
134
136
100
110
112
42
43
33
35
37
58
31
46
48
44
52
54
50
60
106
108
104
76
78
72
68
74
66
64
70
80

HAND GUN MAGAZINE EXTENSION ASSEMBLY

BACKGROUND OF THE INVENTION

1. Field of the Invention

The present invention relates to improvements in magazines for hand guns and, more particularly, pertains to a new and improved magazine extension assembly which attaches to a standard magazine tube and augments the capacity thereof.

2. Description of Related Art

Hand guns are used in a variety of sporting competitions around the country wherein various skills of the competitor are matched against both another opponent and the clock. Key to these competitions is the ability to operate and fire a hand gun quickly and skillfully. An important factor is the number of rounds, or ammunition a particular gun can fire before the instrument needs to be reloaded. Rounds are stored in a cartridge, or magazine, which is of a standard construction to enable uniformity from gun to gun, and the size and dimensions of these magazines are preset by the organizing bodies of the competitions and organizations who sanction the competitions. Designers are always trying to increase the capacity of the magazines while conforming to the guidelines and standards set by these competitions. It is axiomatic that a competitor who spends less time reloading will have an advantage over a similarly situated competitor who must reload more often. The bulk of competition hand guns are built on the Colt 1911 frame, which is the standard side arm issued in World War II by the United States Military. The hand guns built on these frames may be made in a variety of calibers such as 9 millimeter and 10 millimeter, and 38 and 45 calibers.

The magazines for the Colt 1911 house the ammunition in a cartridge having a rectangular base with walls forming a column which narrows in width at the top. The bottom of the magazine is open and terminates in an outwardly directed lip which is used to attach a standard base pad. The magazine includes a spring-loaded follower which feeds rounds individually into the gun from below. At the bottom of the magazine tube, a removable base pad provides a cap and a support for the follower. The capacity of the standard magazine tube with the standard base pad is predetermined. The prior art has sought to increase the capacity in a manner which conforms to the standards set by the competitions.

Aftermarket conversion kits for magazines are plentiful, but the prior art conversion kits are capable of adding only one or two rounds to the holding capacity of the magazine and still remain within the dimensional requirements set forth in the rules for USPSA or IPSC competition.

OBJECTS AND SUMMARY OF THE INVENTION

It is an object of the present invention to provide a magazine tube extension assembly that conforms with the dimensional requirements of competitive shooting and adds multiple round capacity to the magazine;

It is a further object of the present invention to provide a magazine tube adapter and cooperating base pad which can be used with a variety of different magazine tubes to augment the capacity of the magazine; and It is a further object of the present invention to provide an assembly which can be quickly and easily installed and removed, to a variety of magazine tubes of the indicated type, while providing a secure attachment to the magazine tube.

These objects and the general purpose of this invention are accomplished by providing a base pad and a special adapter designed to attach to the base of a magazine tube. The base pad and the adapter mesh together using interlocking tabs and slots. An insertable pin secures the base pad to the adapter. The adapter includes a groove along an interior surface which receives a lip at the base of a magazine tube to fix the adapter to the magazine tube. The lower edge of the adapter includes two tabs, or heels, which depend from the lower edge and which engage slots on the upper surface of the base pad to form an interlocking relationship. A pair of traverse holes pass through both the base pad and the adapter. A clip inserted into the holes removably secures the base pad and adapter assembly. Once the clip is in position, holding the base pad to the adapter, the clip is kept in place by a retaining boss.

BRIEF DESCRIPTION OF THE DRAWINGS

The exact nature of this invention, as well as other objects and advantages, will become readily apparent upon reference to the following detailed description when considered in conjunction with the accompanying drawings, in which like reference numerals designate like parts throughout the figures thereof, and wherein.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined specifically to provide a magazine tube extension assembly which complies with the dimensional requirements of competition shooting and adds at least two rounds to the capacity of the magazine, while securely fastening to the bottom of the magazine and permitting quick and easy attachment and removal.

Figure 1:
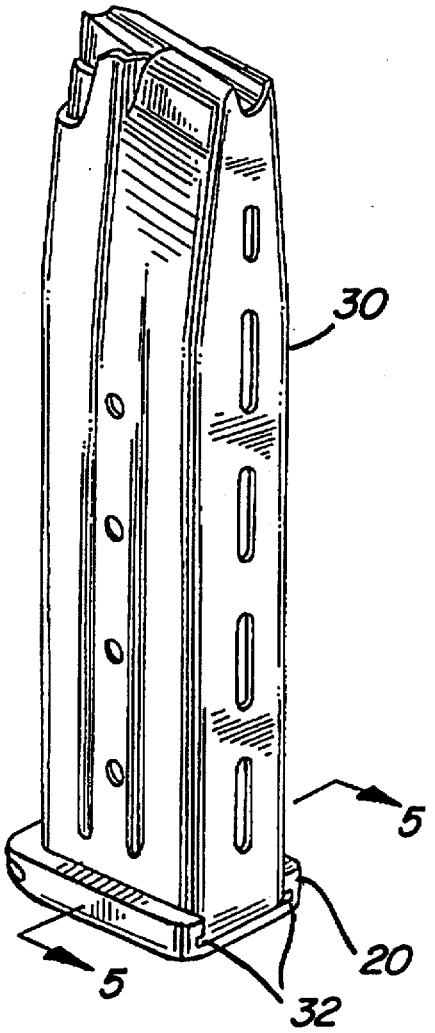
FIG. 1 PRIOR ART
FIG. 1 is a perspective view of a typical magazine tube with a base pad of the prior art.

FIG. 1 illustrates a typical magazine tube 30 as may be commonly used in a 1911-type handgun and the standard base pad 20 which is used in conjunction with the magazine tube 30. The prior art base pad 20 merely closes the bottom of the magazine tube 30 and provides a smooth end to the magazine tube lower edge. The prior art base pad attaches to the magazine tube by means of a pair of grooves which receive outwardly directed lips 32 at the base of the magazine tube.

Figure 2:
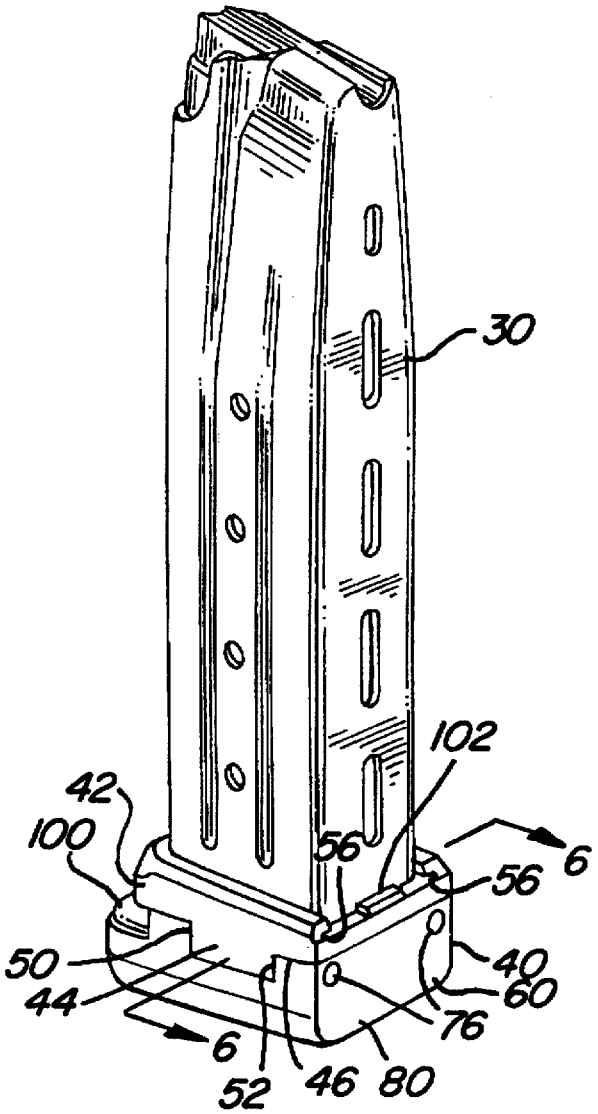
FIG. 2 is a perspective view of a typical magazine with a preferred embodiment of a base pad assembly of the present invention.
Figures 3, 4:
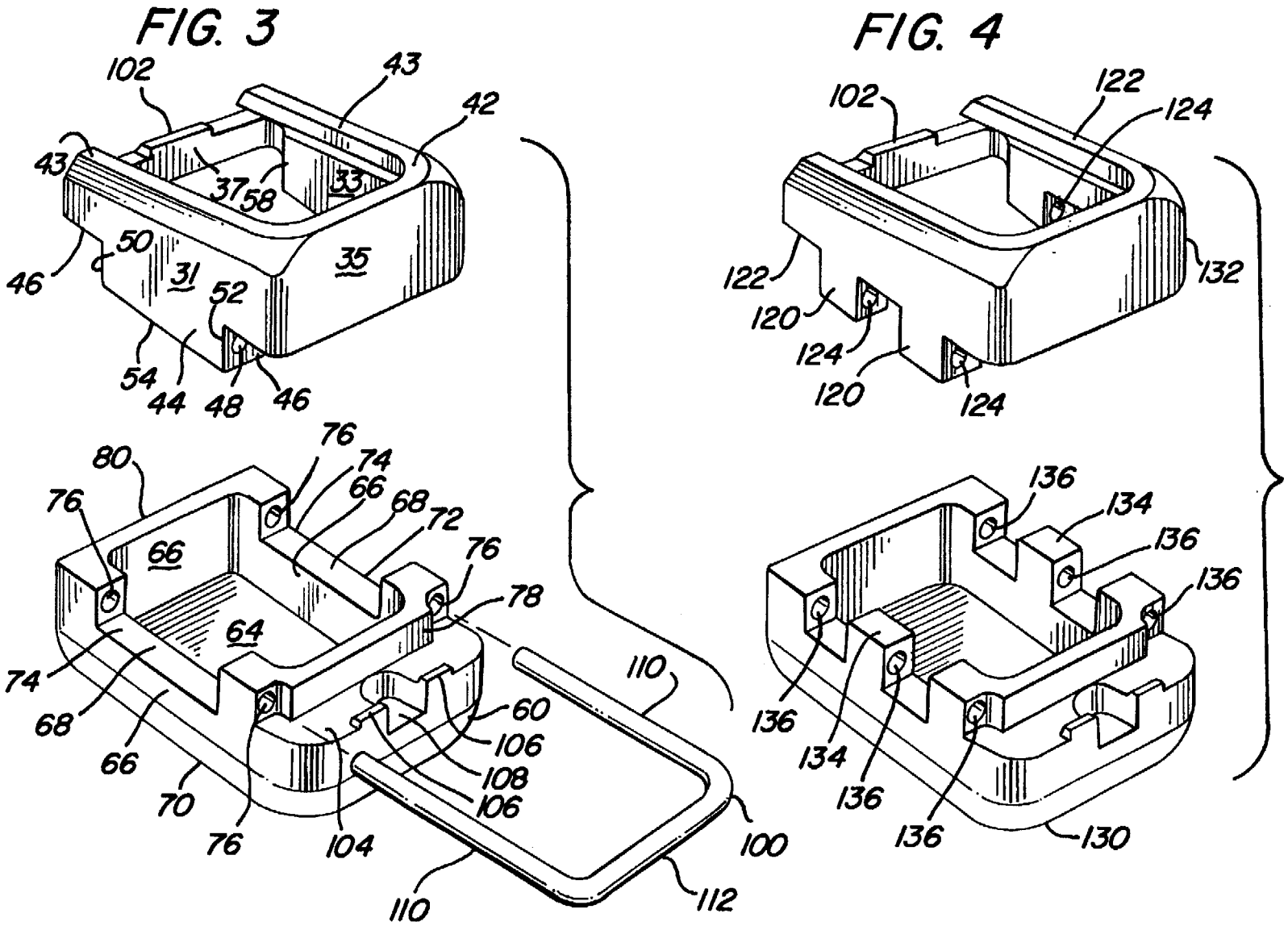
FIG. 3 is an exploded view of a preferred embodiment of a base pad assembly of the present invention.
FIG. 4 is an exploded view of an alternate embodiment of a base pad assembly of the present invention.

FIGS. 2 and 3 illustrate a preferred embodiment of the base pad of the present invention, which comprises a tube adapter 42, a base pad 60, and a pin or clip 100. As shown in FIG. 2, the base pad assembly mounts to the lower edge of the magazine tube 30 by means of slots formed by a continuous groove 56 which follows along the interior edges 58 of the adapter and is shaped to receive the magazine lip tightly therein. A retention boss 102 is provided on the adapter 42 at the entrance to the adapter's groove to retain the magazine tube 30 firmly to the adapter 42. Once the adapter 42 is secured to the base of magazine tube 30, it becomes a permanent fixture on the magazine tube.

As shown in FIG. 3, the adapter 42 of the base pad assembly 40 further includes a generally rectangular body defined by side walls 31, 33, rear wall 35, and a front wall 37. The side walls 31, 33 each have a heel member 44 which depends from a lower longitudinal edge 46 and which are preferably rectangular as shown. The heel members 44 include a hole 48 which passes from a front edge 50 completely through the heel member to a rear edge 52.

The base pad 60 includes a floor 64 and a continuous wall 66 forming a generally rectangular element. The base pad 60 has open slots 68 along the sides 70, 72 which are sized to receive the heel members 44 of the adapter 42 therein. The base pad 60 includes two holes 76 which begins at a front surface 78 of the adapter and continual through the sides 70, 72 of the base pad, passing through the open slots 68 and terminating at the rear surface 80. The holes 76 are aligned with the holes 48 in the heel members 44, such that when the upper surface 74 of the base pad 60 is brought in contact with the lower surface 54 of the adapter 42, the heel members 44 fit snugly into the open slots 68 and a continuous channel through holes 76 and 48 is formed. This continuous channel is illustrated in phantom in FIG. 8 and provides the means for securing the assembly together.

Figure 6:
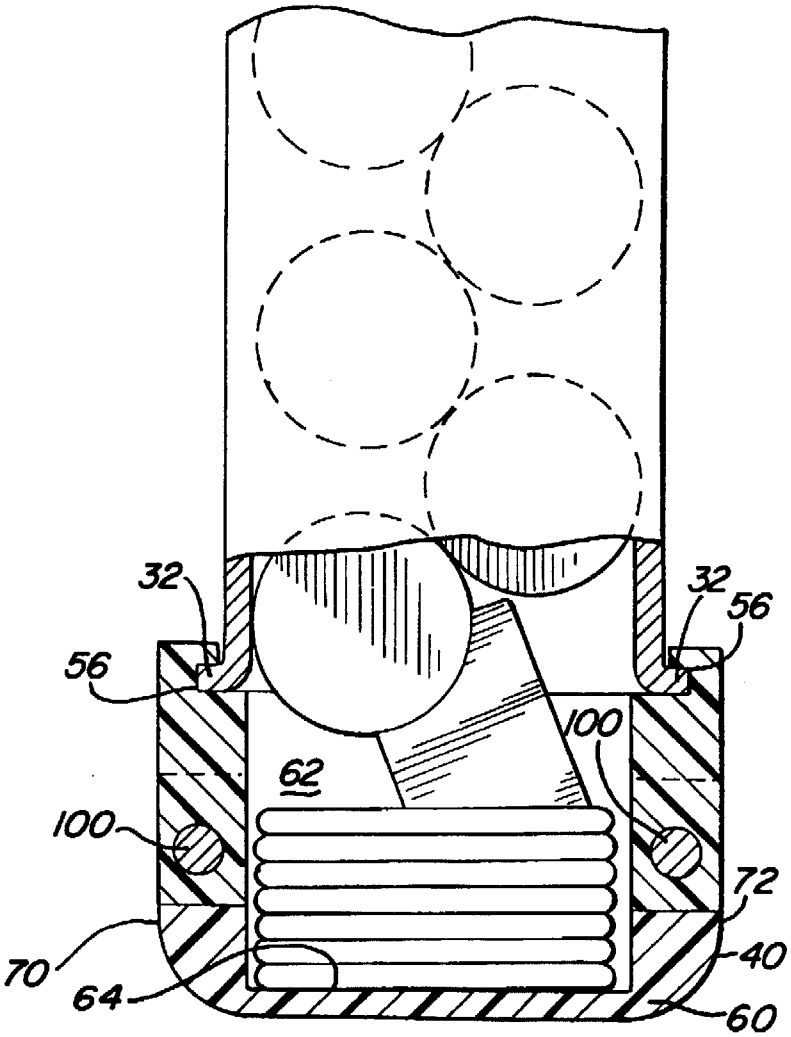
FIG. 6 is a cross-sectional view of the base pad assembly of the present invention.
Figure 5:
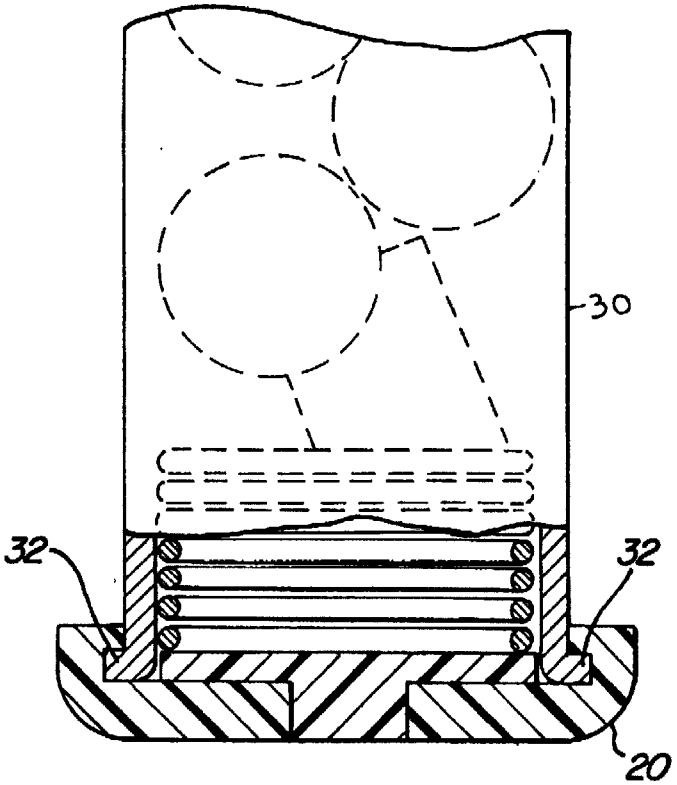
FIG. 5 PRIOR ART
FIG. 5 is a cross-sectional view of the prior art base pad and magazine tube of FIG. 7.

A U-shaped pin or clip 100 is provided which has a cross-section compatible with the cross-section of the continuous channel (shown here in the preferable round embodiment) and which is inserted into the channel to secure the base pad 60 and the adapter 42 together. The clip 100 includes a pair of legs 110 and a traverse member 112. It is preferably made of stainless steel. The base pad and adapter are preferably made of Delron. Once assembled, the base pad 60 and the adapter 42 form a reservoir 62 which can augment the storage capacity of the magazine as comparatively illustrated in FIGS. 5 and 6.

FIG. 4 illustrates a second embodiment wherein the heel member of the previous embodiment is replaced by teeth 120 depending from the lower edge 122 of the adapter 132. Along the corresponding mating surface of the base pad 130 are meshing teeth 134 as required to form a continuous abutment of the two parts. As described above, a traverse hole 124 in the adapter 132 and a traverse hole in the base pad 30 are aligned when the two elements are abutting and provide a continuous channel as in the previous embodiment. A pin is inserted into the continuous channel to secure the elements together.

Figure 7:
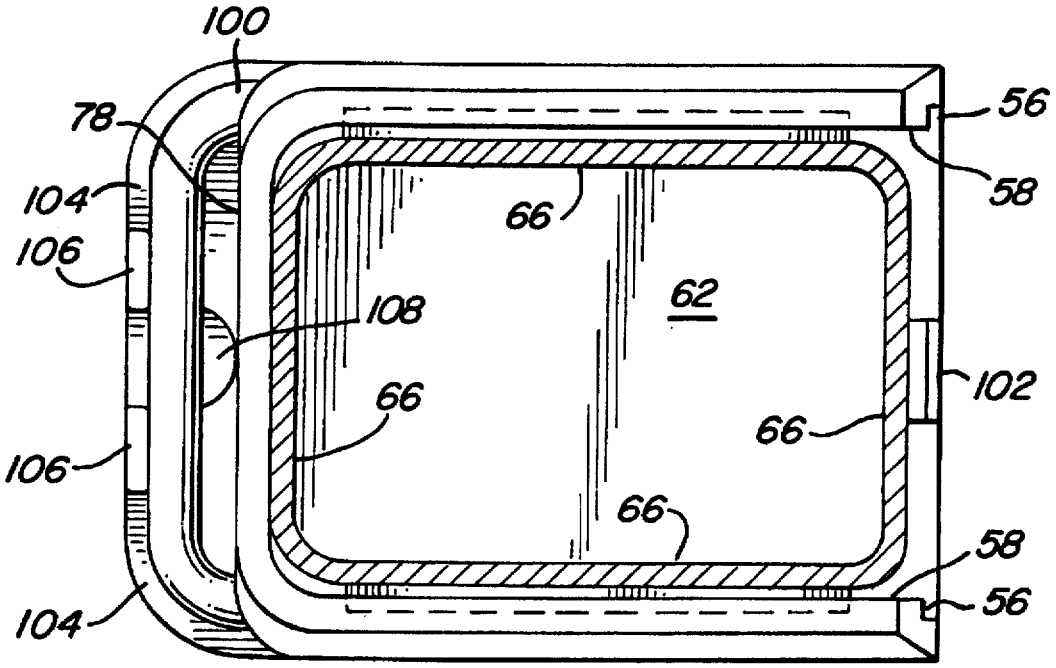
FIG. 7 is a planform view of the base pad assembly of the present invention.
Figure 8:
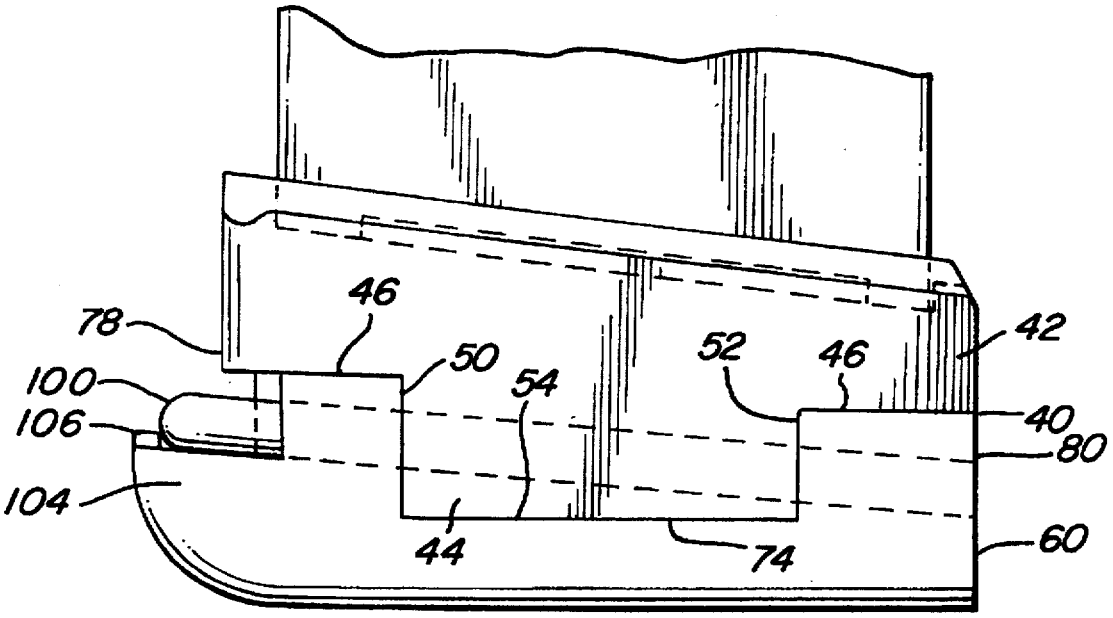
FIG. 8 is a side view partially in phantom of the base pad assembly of the present invention.

FIGS. 7 and 8 illustrate the base pad assembly of the present invention with the pin 100 inserted into the continuous channel formed by the alignment of holes 48 and 76. Tabs 106 are provided on an upper surface of the base pad to secure the pin in the channel and prevent dislodging of the pin 100 after it is fully inserted. As the pin is inserted completely in the channel as shown, it encounters tabs 106 and additional effort is required to push the pin 100 into the channel to overcome the tabs 106. Tabs 106 then serve to retain the pin 100 in the channel. To remove the pin 100, a recess 108 is provided in the base pad 60 just below the traverse member of the pin (see FIGS. 3 and 7). The recess 108 is adapted to receive a bladed instrument such as a screwdriver (not shown), which can be used to pry the pin 100 over tabs 106, and the pin can thereafter be removed and the assembly disassembled. The base pad extends beyond the adapter through an outer ledge 104 to permit the bladed instrument to be inserted into the recess 108 between the pin 100 and the adapter 42.

It will be understood that the embodiments described herein are merely exemplary and that a person skilled in the art may make many variations and modifications without departing from the spirit and scope of the invention. All such variations and modifications are intended to be included within the scope of the invention as defined in the appended claims.

What is claimed is:

1. A magazine extension assembly adapted to mount to a hand gun magazine tube comprising:

an adapter having attachment means for attaching to the lower edge of said magazine tube, said adapter further comprising a pair of heel members depending from first and second generally parallel lower longitudinal edges, each said heel member having a channel passing in a longitudinal direction from a front edge to a rear edge;

a base pad comprising a floor and a continuous wall along the perimeter thereof and a pair of open slots along opposite sides of said wall on an upper surface thereof sized to receive said heel members of said adapter channels extending from a front surface of said base pad to a rear surface of said base pad from a continuous channel with said channels of said heel members when said base pad upper surface bears against a lower surface of said adapter; and pin means insertable into said channels for releasably securing said base pad to said adapter.

2. The magazine extension assembly as recited in claim 1 wherein said attachment means comprises a groove along an inner surface of said adapter, said groove sized to receive a lip of said lower edge of said magazine tube.

3. The magazine extension assembly as recited in claim 2 wherein said adapter further comprises a magazine retention boss at an entrance to said groove.

4. The magazine extension assembly as recited in claim 2 wherein said adapter is comprised of Delron.

5. The magazine extension assembly as recited in claim 1 wherein said channels are inclined with respect to said floor of said base pad.

6. The magazine extension assembly as recited in claim 1 wherein said base pad further comprises an outer ledge at a front surface, said outer ledge guiding said pin means into said channels.

7. The magazine extension assembly as recited in claim 6 wherein said outer ledge includes means for retaining said pin means in said channels.

8. The magazine extension assembly as recited in claim 7 wherein said means for retaining said pin means comprises a tab on an upper surface of said outer ledge.

9. The magazine extension assembly as recited in claim 6 wherein said outer ledge further comprises recess means adjacent said pin means and adapted to receive a bladed instrument for prying said pin means from said channels.

10. The magazine extension assembly as recited in claim 1 wherein said base pad is comprised of Delron.

11. The magazine extension assembly as recited in claim 1 wherein said pin means comprises a clip having a U-shaped profile comprising a pair of legs and a connecting traverse support member, said pair of legs spaced apart so as to be insertable into said channels simultaneonsly.

12. The magazine extension assembly as recited in claim 11 wherein said base pad further includes an outer ledge at a front surface, said outer ledge supporting the traverse support member of said clip when said pair of legs are inserted into said channels.

13. The magazine extension assembly as recited in claim 11 wherein said clip is comprised of stainless steel.

14. The magazine extension assembly as recited in claim 11 wherein said clip has a circular cross-section and said channels are circular in profile.

15. The magazine extension assembly as recited in claim 1 wherein said assembly further comprises said magazine having a lower edge and a lip at said lower edge.

16. A magazine extension assembly adapted to mount to a hand gun magazine robe comprising:

a generally rectangular adapter having attachment means for attaching to a lower edge of said magazine tube, said adapter further comprising a plurality of teeth depending from first and second generally parallel lower longitudinal edges, each of said teeth including a traverse channel and each said channel aligned with each adjacent said channel to form first and second straight channels through said teeth;

a base pad comprising a floor and a continuous wall along the perimeter thereof, said base pad having teeth along an upper surface of said continuous wall at first and second sides thereof, said teeth adapted to mesh with said teeth of said adapter, including traverse channels aligned with said channels in said adapter teeth to form two continuous channels each passing through both said adapter and said base pad; and pin means insertable into said continuous channels for releasably securing said base pad to said adapter.

17. The magazine extension assembly as recited in claim 16 wherein said attachment means comprises a groove along an inner surface of said adapter, said groove sized to receive a lip of said lower edge of said magazine.

18. The magazine extension assembly as recited in claim 17 wherein said adapter further comprises a magazine retention boss at an entrance to said groove.

19. The magazine extension assembly as recited in claim 17 wherein said adapter is comprised of Delron.

20. The magazine extension assembly as recited in claim 16 wherein said channels are inclined with respect to said floor of said base pad.

21. The magazine extension assembly as recited in claim 16 wherein said base pad further comprises an outer ledge at a front surface, said outer ledge guiding said pin means into said channels.

22. The magazine extension assembly as recited in claim 21 wherein said outer ledge includes means for retaining said pin means in said channels.

23. The magazine extension assembly as recited in claim 22 wherein said means for retaining said pin means comprises a tab on an upper surface of said outer ledge.

24. The magazine extension assembly as recited in claim 21 wherein said outer ledge further comprises recess means adjacent said pin means and adapted to receive a bladed instrument for cooperating with said bladed instrument to permit prying of said pin means from said channels.

25. The magazine extension assembly as recited in claim 16 wherein said base pad is comprised of Delron.

26. The magazine extension assembly as recited in claim 16 wherein said pin means comprises a clip having a U-shaped profile comprising a pair of legs and a connecting traverse support member, said pair of legs spaced apart so as to be insertable into said channels simultaneously.

27. The magazine extension assembly as recited in claim 26 wherein said base pad further includes an outer ledge at a front surface, said outer ledge supporting the traverse support member of said clip when said pair of legs are inserted into said channels.

28. The magazine extension assembly as recited in claim 26 wherein said clip is comprised of stainless steel.

29. The magazine extension assembly as recited in claim 26 wherein said clip has a circular cross-section and said channels are circular in profile.

* * * * *